United States Patent [19]

Preissler et al.

[11] Patent Number: 4,995,249

[45] Date of Patent: Feb. 26, 1991

[54] DOOR HANDLE ASSEMBLY WITH HOLLOW KNOB AND INTERCHANGEABLE LOCK CORE

[75] Inventors: Christopher M. Preissler, Indianapolis; William R. Foshee, deceased, late of Indianapolis, both of Ind., Carolyn S. Foshee, administratix

[73] Assignee: Best Lock Corporation, Indianapolis, Ind.

[21] Appl. No.: 425,704

[22] Filed: Oct. 23, 1989

[51] Int. Cl.[5] ..... E05B 13/10

[52] U.S. Cl. ..... 70/224; 70/367; 70/369

[58] Field of Search ..... 70/215, 216, 224, 367-371, 70/DIG. 39

[56] References Cited

U.S. PATENT DOCUMENTS

| | | | |
|---|---|---|---|
| Re. 31,910 | 6/1985 | Oliver | 70/369 |
| 1,568,441 | 1/1926 | Best | 70/370 |
| 2,079,583 | 5/1937 | Brauning | 70/224 |
| 2,484,961 | 10/1949 | Russell et al. | 70/379 X |
| 3,019,633 | 2/1962 | Russell et al. | 70/224 |
| 3,286,773 | 11/1966 | Russell et al. | 70/224 X |
| 3,298,211 | 1/1967 | Russell et al. | 70/369 |
| 4,052,868 | 10/1977 | Best et al. | 70/370 X |
| 4,312,201 | 1/1982 | Roos . | |
| 4,342,478 | 8/1982 | Foshee . | |
| 4,394,821 | 7/1983 | Best et al. . | |
| 4,428,212 | 1/1984 | Best et al. . | |
| 4,428,570 | 1/1984 | Foshee et al. . | |
| 4,435,967 | 3/1984 | Best et al. . | |
| 4,437,695 | 3/1984 | Foshee . | |
| 4,672,829 | 6/1987 | Gater et al. | 70/224 X |
| 4,715,201 | 12/1987 | Craig | 70/367 X |
| 4,765,163 | 8/1988 | Trull et al. | 70/224 |

*Primary Examiner*—Gary L. Smith
*Assistant Examiner*—Suzanne L. Dino
*Attorney, Agent, or Firm*—Barnes & Thornburg

[57] ABSTRACT

A door handle assembly includes a hollow knob shell, a lock core having a front end formed to include a keyway opening, and a unitary core retainer sleeve situated inside an interior cavity of the knob shell. The unitary core retainer sleeve is formed to include means for supporting the lock core inside the interior cavity so that the front end of the lock core is positioned to lie in a front opening of the knob shell to permit a user to insert a key into the keyway opening.

24 Claims, 1 Drawing Sheet

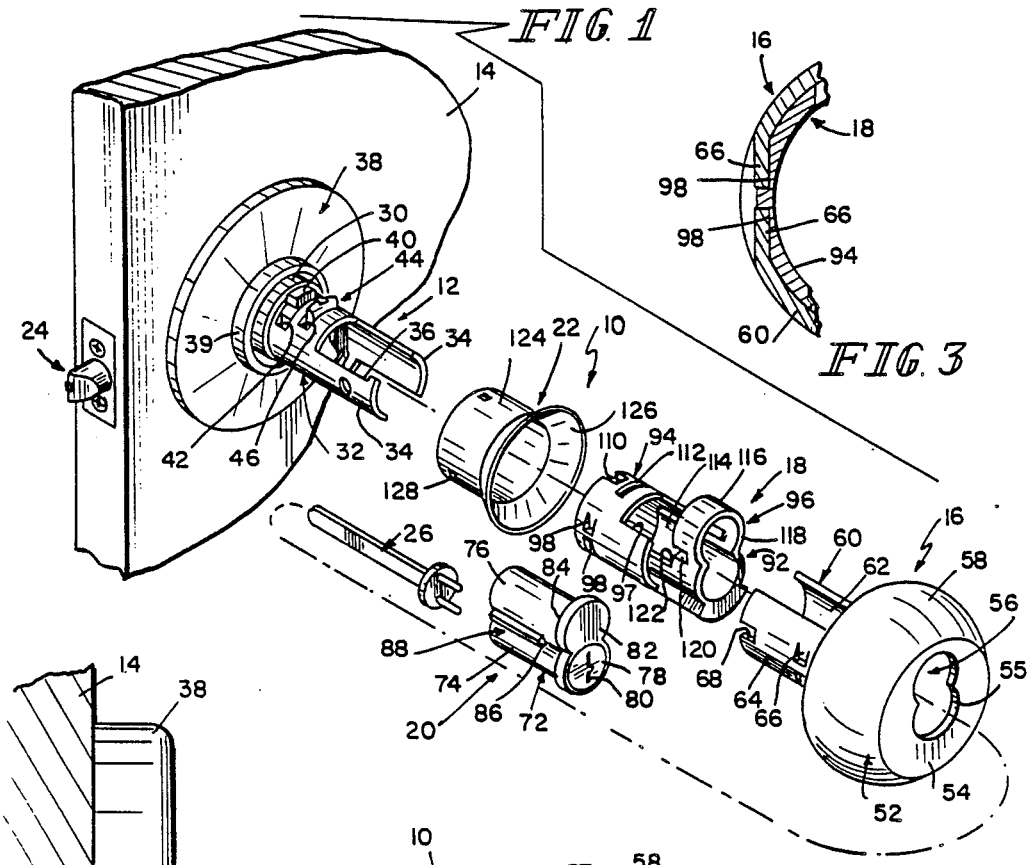
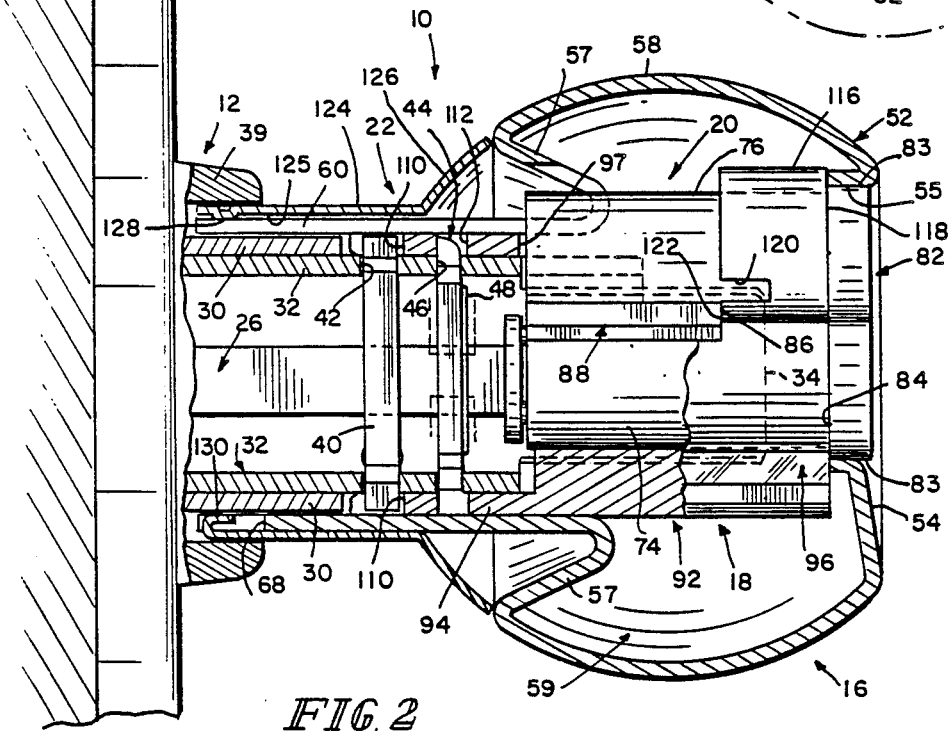
FIG. 2

DOOR HANDLE ASSEMBLY WITH HOLLOW KNOB AND INTERCHANGEABLE LOCK CORE

BACKGROUND AND SUMMARY OF THE INVENTION

The present invention relates to a door handle assembly and, in particular, a key-actuated interchangeable lock core supported in a hollow doorknob or the like. More particularly, the present invention relates to a door handle assembly having a unitary core retainer sleeve for supporting an interchangeable lock core in a hollow doorknob.

Machined doorknobs made by machining solid brass stock are known. Machined brass doorknobs provide a great measure of security and accept interchangeable lock cores and other lock-actuating linkages as shown, for example, in U.S. Pat. Nos. 4,437,695; 4,435,967; 4,428,570; 4,428,212; 4,394,821; 4,342,478; and 4,312,201. The outer end opening in a machined knob is generally closed by a separate face plate carrying an inwardly extending boss which forms a seat for an interchangeable lock core as shown, for example, in U.S. Pat. No. 4,342,478 to Foshee.

Stamped doorknobs can provide satisfactory security in many applications and are less costly to produce than machined knobs. However, a shortcoming of conventional stamped doorknobs is that they do not include easily assembled means for holding a lock core in the hollow region of the stamped doorknob.

An object of the present invention is to provide a unitary core retainer sleeve for supporting an interchangeable lock core in its proper place inside a stamped hollow doorknob.

Another object of the present invention is to provide a core retainer sleeve which is configured to support an interchangeable lock core and mount directly on conventional lock chassis so that the door handle assembly of the present invention can be retrofitted onto an existing lock chassis to serve as a replacement for a conventional door handle unit.

According to the present invention, a door handle assembly includes a hollow knob shell having a front face and an interior cavity having a front opening in the front face, a lock core, and a unitary core retainer sleeve situated inside the interior cavity and coupled to the knob shell. The lock core has a front end formed to include a keyway opening. The unitary core retainer sleeve is formed to include means for supporting the lock core inside the interior cavity so that the front end of the lock core is positioned to lie in the front opening of the knob shell to permit a user to insert a key into the keyway passage opening.

In preferred embodiments, the core retainer sleeve includes a forwardly presented edge facing toward the front opening formed in the front face of the knob shell. The forwardly presented edge defines a lock core-receiving opening in the core retainer sleeve which communicates with the front opening in the knob shell. The front end of the lock core includes a rearwardly presented edge engaging the forwardly presented edge of the core retainer sleeve to limit movement of the lock core into the interior cavity provided in the knob shell. Once the edge on the lock core engages the edge on the core retainer sleeve, the lock core is fully supported in a cradle formed in the sleeve and situated in a proper location relative to the knob shell and its front opening.

The unitary core retainer sleeve also includes a rearwardly presented surface for anchoring the lock core in its proper position in the knob shell. The lock core is a key-actuated interchangeable core of the type including a core body and a control lug movable relative to the core body to control the release of the lock core from its place in the core retainer sleeve. The control lug normally occupies a core-blocking position engaging the rearwardly presented surface of the sleeve to block removal of the lock core from the core retainer sleeve through the lock core-receiving opening. The control lug is movable from its normal position to a core-releasing position disengaging the rearwardly presented surface to permit removal of the lock core from the retainer sleeve through the lock core-receiving opening. The control lug is moved relative to the core body using a control key inserted into the keyway provided in the interchangeable lock core. A separate operating key is usable to control locking and unlocking the door handle assembly itself.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 1 is an exploded perspective view illustrating installation of a door handle assembly in accordance with the present invention onto a handle unit mounted in a door;

FIG. 2 is an enlarged axial section view of the door handle assembly of FIG. 1 following installation of the assembly in a mounted position on a door, the view showing use of a unitary core retainer sleeve coupled to the inner wall of a tubular shank on a knob to support a lock core in the interior cavity of the hollow knob; and FIG. 3 is a partial transverse sectional view taken along lines 3—3 of FIG. 2 showing a staked connection joining the tubular shank to the core retainer sleeve.

DETAILED DESCRIPTION OF THE DRAWINGS

The present invention solves the problem of retaining an interchangeable lock core within the confines of a hydraulically formed, stamped, hollow doorknob provided with a cylindrically hollow shank according to the limits specified in the American National Standards Institute for cylindrical locksets (ANSI 156.2 Grade 1). Conventional techniques for holding and positioning interchangeable locks cores within a hollow stamped doorknob generally have proven to be unsatisfactory. The door handle assembly of the present invention overcomes core-mounting problems associated with stamped doorknobs by using a unitary core retainer sleeve to support an interchangeable lock core in its proper position inside a hollow knob shell.

Referring to FIG. 1, the door handle assembly 10 of the present invention is shown in its disassembled state of illustrate how few parts are included in the assembly 10. The door handle assembly 10 is connectable to a spindle assembly 12 mounted in a conventional way on a door 14. The assembly 10 includes a knob 16 or the like, a core retainer sleeve 18, an interchangeable lock core 20, and a trim ring 22. The core retainer sleeve 18 fits inside the hollow portion of the knob 16 and holds the lock core 20 in place. The trim ring 22 is attached to the spindle assembly 12 to cover the rear portion of the knob 16 facing the door 14.

A conventional throw member 26 interconnects the tail end of the lock core 20 and a bolt retractor mechanism (not shown) mounted inside door 14 in the conventional way. The lock core 20 can be operated using an operating key to rotate the throw member 26 about its longitudinal axis to either lock or unlock the bolt retractor mechanism (not shown). When unlocked, the retractor mechanism (not shown) can be actuated by rotating the door handle assembly 10 about its axis of rotation to retract a latch bolt 24 mounted in an end face of door 14.

As shown best in FIG. 1, spindle assembly 12 includes a cylindrical hub 30 fixed to door 14 and an elongated tubular knob sleeve 32 that extends through a central passageway of hub 30 and lies in rotative bearing engagement with the inner wall of hub 30 which defines the central passageway. The knob sleeve 32 extends outwardly away from door 14 and includes a pair of axially extending prongs 34 arranged to lie in spaced-apart parallel relation at the distal end of the knob sleeve. A longitudinally extending undercut 36 is formed in one of the prongs 34 to provide clearance for movement of a control lug 88 on the lock core 20 to its projected core-retaining position. A part of the distal end of each prong 34 will engage companion slots formed in the core retainer sleeve 18 as described below.

A trim or rose cover 38 is provided with an annular lip 39 formed to include a central aperture for receiving cylindrical hub 30 therein. The rose cover 38 is mounted against the door 14 to provide a decorative secure cover situated between the door 14 and door handle assembly 10.

A knob driver 40 is mounted in knob sleeve 32 in the conventional way and extends radially outwardly from knob sleeve 32 through slots 42 formed in the knob sleeve 32. The radially outwardly extending tab of knob driver 40 extends into a slot 110 formed in the core retainer sleeve 18 as shown in FIG. 2. The knob sleeve 32 rotates about its longitudinal axis to operate the bolt retractor (not shown) in response to manual rotation of the door handle assembly 10 because of the driving connection between the knob sleeve 32 and the core retainer sleeve established by knob driver 40.

A knob keeper 44 is also mounted on knob sleeve 32 in a location intermediate knob driver 40 and the proximal portions of the axially extending prongs 34. Knob keeper 44 is normally biased in a radially outward direction by a spring 48 to secure the door handle assembly 10 to spindle 12 in the usual way. The knob keeper 44 is biased by spring 48 to engage in a slot 112 formed in the core retainer sleeve as shown in FIG. 2. When biased to its radially outward position shown in FIG. 2, knob keeper 44 prevents axial movement of the door handle assembly 10 relative to the spindle assembly 12 to prevent unauthorized removal of the door handle assembly from its mounted position on door 14.

The knob keeper 44 is accessible upon key-actuated removal of lock core 20 from its place in the hollow knob 16 so that a tool (not shown) can be used to urge knob keeper 44 inwardly against the bias of spring 48 to a position releasing the core retainer sleeve 18 from locked engagement to the knob sleeve 32. As shown in FIG. 2, each slot 110 has an open mouth facing door 14 so that the core retainer sleeve 18 can be removed from the knob sleeve 32 without first removing the knob driver 40 from the knob sleeve 32. Alternatively, an aperture (not shown) could be provided in the trim ring 22 to permit a tool (not shown) to enter into the interior of door handle assembly 10 so that the tool could be pushed against knob keeper 44 to move it to its handle-releasing position.

Knob 16 includes a hollow knob shell 52 provided with an integral front face 54. Knob 16 is preferably stamped using conventional stamping techniques out of brass, bronze, or stainless steel. An inner edge 55 of front face 54 is shaped to define a figure-8 opening 56 sized to receive the interchangeable lock core 20 therein. The hollow knob shell 52 includes a somewhat spherical grip portion 58 that cooperates with front face 54 and an axially inwardly, conically shaped, folded wall 57 to define an interior cavity 59 inside knob shell 52. The interior cavity 59 is sized to hold lock core 20 and a forward portion of the core retainer sleeve 18 therein.

A tubular shank 60 extends away from a rearward portion of the folded wall 57 to provide a means for connecting the knob 16 to the core retainer sleeve 18. Essentially, the core retainer sleeve 18 is supported on an inner surface 62 of tubular shank 60 as shown best in FIG. 2. Staking tabs 66 are formed by pressing against the outer surface 64 of tubular shank 60 to engage in staking slots 98 provided in the core retainer sleeve 18. The tubular shank 60 also includes a slot 68 at its distal end to provide means for permitting connection of the trim ring 22 to the knob 16.

Tubular shank 60 is formed to include a central passage extending therethrough and opening at its forward end into the interior cavity 59 provided in knob shell 52. This opening is provided at the juncture between the tubular shank 60 and the knob shell 52 as shown best in FIG. 2. Portions of the tubular shank 60 and folded wall 57 are cut away along the top of knob 16 to permit entry of a top portion of the core retainer sleeve 18 into the interior cavity 59 of the hollow knob shell 52.

The interchangeable lock core 20 includes a core body 72 having a lower lobe 74 and upper lobe 76. A conventional key plug 78 is mounted in the lower lobe 74 and formed to include a keyway 80 for accepting both control and operating keys. The front end 82 of the core body 72 is enlarged somewhat with respect to the remainder of the core body 72 to provide a rearwardly presented figure-8-shaped edge 84. A control lug 88 is movable relative to the core body 72 in the conventional way to provide means for retaining the lock core in a fixed position within the knob 16. A control key (not shown) can be inserted into keyway 80 and rotated relative to the lock core 20 to move the control lug 88 from a recessed or retracted position (not shown) within the core body 72 to a projected position shown in FIGS. 2 and 3 to expose front face 86 of the control lug 88. In this projected position, the lock core 20 will be locked to the core retainer sleeve 18 in the manner to be described below.

The core retainer sleeve 18 is a one-piece zinc die casting that slides onto the distal end of the knob sleeve 32. The sleeve 18 holds the lock core 20 in place in the interior cavity 59 of the knob 16 and also holds the knob 16 in place on the spindle assembly 12. The core retainer sleeve 18 includes an elongated base 92 having a tubular knob support shaft 94 at its rear end for mounting onto knob sleeve 32 and a cradle-like core support fixture 96 at its forward end for holding the lock core 20. A rearward portion of the core support fixture 96 extends a short distance into the forward opening of the knob support shaft 94 as shown best in the perspective view provided in FIG. 1, to reduce the overall length of sleeve 18 while ensuring that lock core 20 is fully supported along its length by the core retainer sleeve 18.

The knob support shaft 94 is formed to include an open-ended slot 110 at its rear end to receive the radially outwardly extending tab on knob driver 40. A slot 112 is also formed in knob support shaft 94 just ahead of slot 110 to receive the radially outwardly biased knob keeper 44. Staking slots 98 are formed in the exterior wall of knob support shaft 94 on either side of slots 110 and 112 to receive matching staking tabs 66 provided on the tubular shank 60 of knob 16. Engagement of tabs 66 into slots 98 couples knob 16 to core retainer sleeve 18 so that knob 16 and sleeve 18 rotate as a unit to engage the knob driver 40 and rotate the knob sleeve 32 about its axis of rotation to operate the bolt retractor (not shown). The knob support shaft 94 further includes a cutaway section 97 just ahead of the keeper slot 112 to receive the upper lobe 76 of the rearward end of the lock core 20.

The core support fixture 96 on sleeve 18 includes a lock core cradle 114 configured to wrap around a portion of the lower lobe 74 to form a channel for slidably receiving the lock core 20 therein. An arch member 116 is appended to the forward end of cradle 114 and extends vertically upwardly to wrap around the remaining exterior surface of the front end of the lower lobe 74 as well as the exterior surface of the front end of the upper lobe 76. The arch member 16 cooperates with an underlying portion of the cradle 114 to provide a short sleeve formed to include a central figure-8-shaped passageway therein. The passageway is sized to match the figure-8 cross-sectional shape of the lock core 20.

As seen best in FIG. 1, the front face 118 of the core retainer sleeve 18 has a figure-8 shape. Rearwardly opening slots 120 are formed in the rear portion of arch member 116 at the seam between the upper and lower lobe-receiving portions of sleeve 18 to receive the spaced-apart, axially extending prongs 34 on the knob sleeve 32. Thus, core retainer sleeve 18 is matable with the spindle assembly 12 to facilitate attachment of door handle assembly 10 onto an existing lock chassis such as spindle assembly 12 and increase its utility as a replacement door handle assembly.

Lock core 20 is insertable into core retainer sleeve 18 and movable onto the figure-8-shaped central passage in arch member 116 until the rearwardly facing figure-8-shaped edge 84 of lock core 20 engages the figure-8-shaped front face 118 of core retainer sleeve 18. Such engagement blocks further inward movement of lock core 20 with respect to core retainer sleeve 18. At this point, the lock core 20 can be anchored in position in core retainer sleeve 18 by moving the control lug 88 to its projected position presenting the small front face 86 of control lug 88 in opposition to a rear face 122 on arch member 116. Lock core 20 will remain in a fixed axial position seated in lock core cradle 114 provided in sleeve 18 until the control lug 88 is later moved to its retracted position inside the core body 72 by means of a control key. As shown best in FIG. 2, the core support fixture 96 extends forward in the interior cavity 69 far enough to position the front end 82 of core body 72 in the figure-8 opening 56 formed in the front face 54 of knob 16. The inner edge 55 embraces the radially outwardly presented surface 83 of front end 82.

Trim ring 22 includes an elongated sleeve 124 having a central aperture 125 formed therein for slidably receiving the knob shank 60. A flared portion 126 is appended to the forward part of sleeve 124 and shaped to mate with the grip portion 58 to provide knob 16 with a spherical appearance. Trim ring 22 is preferably stamped out of brass, bronze, or stainless steel. As noted above, an aperature (not shown) could be provided in flared portion 126 to permit a tool to be inserted into door handle assembly 10 and urges against the knob keeper 44 if the assembly 10 was to be used, for example, as an inside doorknob.

A plurality of friction tabs 128 are provided on the inner wall 125 of sleeve 124 to establish a frictional connection between the trim ring sleeve 124 and the knob shank 60. In addition, as shown in FIG. 2, trim ring 22 includes a bent tab 130 which engages in a slot 68 formed at the distal end of knob shank 60 to block rotation of the trim ring 22 relative to the doorknob 16 about the axis of rotation of the knob sleeve 32.

The core retainer sleeve 18 acts to hold the shape of the core body 72 from behind the core face 82 to the key stop. This feature gives added strength and rigidity to the door handle assembly 10 in case one tries to pull the lock core 20 from its home in knob 16. The control lug 88 of the lock core 20 will not offset the pulling forces from behind the knob face when pulling the core 20, but will allow such force to be applied uniformly to the face of the knob.

Staking the knob 16 to the core retainer sleeve 18 allows high values of torque and axial force to be applied to knob 16 without damaging the door handle assembly 10. The configuration and loction of driver and keeper slots 110, 112 and the basic configuration of the core retainer sleeve 18 enable a user to remove the present knob on an installed chassis and insert replacement door handle assembly 10 in its place without any chassis modifications. Zinc alloy casting advantageously permits production of complex parts efficiently at relatively low cost. Thus, core retainer sleeve 118 can be cast completely as illustrated without the need for any costly secondary machining operations.

Although the invention has been described an defined in detail with reference to certain preferred embodiments, variations and modifications exist within the scope and spirit of the invention as described and defined in the following claims.

What is claimed is:

1. A door handle assembly for connection to a rotatable spindle assembly, the door handle assembly comprising a hollow knob shell having a front face, the knob shell being formed to include an interior cavity having a front opening in the front face, a lock core having a front end formed to include a keyway passage opening, and a unitary core retainer sleeve situated inside the interior cavity and coupled to the knob shell, the unitary core retainer sleeve being formed to include means for supporting the lock core inside the interior cavity so that the front end of the lock core is positioned to lie in the front opening of the knob shell to permit a user to insert a key into the keyway passage opening, and wherein the unitary core retainer sleeve is mounted on the rotatable spindle assembly for rotation therewidth.

2. The door handle assembly of claim 1, wherein the knob shell further includes an elongated shank and a hollow grip portion defining the interior cavity and interconnecting the shank and the front face, and the core retainer sleeve further includes a shaft appended to the supporting means and attached to the shank to couple the core retainer sleeve to the knob shell.

3. The door handle assembly of claim 2, wherein the shank includes an inner wall defining a passageway extending through the shank and having an opening into the interior cavity provided in the hollow grip portion, and the shaft extends into the passageway and includes an outer wall engaging the inner wall of the shank.

4. The door handle assembly of claim 2, wherein the shaft is formed to include at least one staking slot and the shank includes at least one staking tab bent to engage the at least one staking slot to establish a connection attaching the shaft to the shank.

5. The door handle assembly of claim 2, further comprising a spindle assembly having a knob sleeve connected to a latch bolt in a door for rotation about a longitudinal axis of the knob sleeve, the shaft being formed to include a longitudinally extending knob sleeve-receiving passageway therein and a driver-receiving slot opening into the longitudinally extending passageway, and the spindle assembly further includes a knob driver coupled to the knob sleeve to project into the driver-receiving slot to establish means for rotationg the knob sleeve about its longitudinal axis in response to rotation of the knob shell about said longitudinal axis.

6. The door handle assembly of claim 2, further comprising a spindle assembly having a knob sleeve connected to a latch bolt in a door for rotation about a longitudinal axis of the knob sleeve, the shaft being formed to include a longitudinally extending knob sleeve-receiving passageway therein and a keeper-receiving slot opening into the longitudinally extending passageway, and the spindle assembly further includes a knob keeper biased against the knob sleeve to project into the keeper-receiving slot to establish means for blocking relative movement of the knob sleeve and the shaft along the longitudinal axis of the knob sleeve so that the knob shell is fixed against axial movement with respect to the knob sleeve.

7. The door handle assembly of claim 1, wherein the rotatable spindle assembly includes a pair of axially extending prongs and the mounting means includes a pair of slots sized to receive the prongs.

8. The door handle assembly of claim 7, wherein the unitary core retainer sleeve includes a base member and an arch member integral with the base member, and the arch member is formed to include the slots.

9. A door handle assembly comprising a hollow knob shell having a front face, the knob shell being formed to include an interior cavity having a front opening in the front face, a lock core having a front end formed to include a keyway passage opening, and a unitary core retainer sleeve situated inside the interior cavity and coupled to the knob shell, the unitary core retainer sleeve being formed to include means for supporting the lock core inside the interior cavity so that the front end of the lock core is positioned to lie in the front opening of the knob shell to permit a user to insert a key into the keyway passage opening, the supporting means including a base member engaging a bottom portion of the lock core and an arch member appended to the bottom portion and arranged to engage a top portion of the lock core.

10. The door handle assembly of claim 9, wherein the arch member and the base cooperate to define a lock core-receiving opening adjacent to the front opening formed in the front face of the knob shell, the lock core includes a core body and a control lug movable relative to the core body between a core-blocking position engaging the arch member to block removal of the lock core from the core retainer sleeve through the lock core-receiving opening and a core-releasing position disengaging the arch member to permit removal of the lock core from the core retainer sleeve through the lock core-receiving opening.

11. In a door handle assembly of the type having a knob sleeve supported for rotation about an axis to actuate a latch bolt, a knob shell formed to include an interior cavity having a front opening, and a lock core disposed in the interior cavity to control locking and unlocking of the latch bolt, the improvement comprising a unitary core retainer sleeve extending into the interior cavity and including means for mounting on the knob sleeve so that the unitary core retainer sleeve rotates with the knob sleeve and a core support fixture positioned to lie in close proximity to the front opening of the interior cavity, the lock core being seated on the core support fixture and including means for releasably engaging the core support fixture to anchor the lock core in a fixed position on the core support fixture so that a user can insert a key into a keyway provided in the lock core through the front opening formed in the knob shell.

12. The improvement of claim 11, wherein the knob shell includes a hollow grip portion defining the interior cavity and an elongated shank appended to the hollow grip portion, and the core retainer sleeve further includes a shaft appended to a rear end of the core support fixture to extend in a direction toward the knob sleeve and attached to the shank to couple the core retainer sleeve to the knob shell.

13. The improvement of claim 12, wherein the shank includes an inner wall defining a passageway extending through the shank and having an opening into the interior cavity provided in the hollow grip portion, and the shaft extends into the passageway and includes an outer wall engaging the inner wall of the shank.

14. The improvement of claim 12, wherein the shaft is formed to include at least one staking slot and the shank includes at least one staking tab bent to engage the at least one staking slot to establish a connection attaching the shaft to the shank.

15. The improvement of claim 12, wherein the shaft is formed to include a longitudinally extending knob sleeve-receiving passageway therein and a driver-receiving slot opening into the longitudinally extending passageway, the improvement further comprising a knob driver coupled to the knob sleeve to project into the driver-receiving slot to establish means for rotating the knob sleeve about its axis of rotation in response to rotation of the knob shell about said axis of rotation.

16. The impovement of claim 12, wherein the shaft is formed to include a longitudinally extending knob sleeve-receiving passageway therein and a keeper-receiving slot opening into the longitudinally extending passageway, the improvement further comprising a knob keeper biased against the knob sleeve to project into the keeper-receiving slot to establish means for blocking relative movement of the knob sleeve and the shaft along the axis of rotation of the knob sleeve so that the knob shell is fixed against axial movement with respect to the knob sleeve.

17. The door handle assembly of claim 11, wherein the knob sleeve includes a pair of axially extending prongs and the mounting means includes a pair of slots sized to receive the prongs.

18. The door handle assembly of claim 17, wherein the unitary core retainer sleeve includes a base member and an arch member integral with the base member, and the arch member is formed to include the slots.

19. In a door handle assembly of the type having a knob sleeve supported for rotation about an axis to actuate a latch bolt, a knob shell formed to include an interior cavity having a front opening, and a lock core disposed in the interior cavity to control locking and unlocking of the latch bolt, the lock core having a core body of Figure 8 cross-section having an upper lobe and an integral lower lobe, the improvement comprising a unitary core retainer sleeve extending into the interior cavity and including a core support fixture positioned to lie in close proximity to the front opening of the interior cavity, the core support fixture including a first surface facing toward the front opening, a second surface facing away from the front opening, a base member underlying the lower lobe to support the lock core in the interior cavity and an arch member engaging the upper lobe to align the core body in a predetermined orientation inside the interior cavity of the knob shells so that a front end of the lock core is presented toward the front opening in the knob shell while the lock core is retained in said fixed position on the core support fixture, and the engaging means includes an edge on the core body engaging the first surface to establish said fixed position for the lock core on the core support fixture and a control lug movable relative to the core body between a core-retaining position arranged to engage the second surface to block removal of the lock core from the interior cavity through the front opening and a core-releasing position arranged to disengage the second surface to permit removal of the lock core from its seated position on the core support fixture in the interior cavity through the front opening.

20. The improvement of claim 19, wherein the knob shell includes a lip extending inwardly along the axis of rotation of the knob sleeve into the interior cavity, the lip includes a radially inwardly facing surface defining the boundary of the front opening in the knob shell and engaging a radially outwardly facing edge of the front end of the core body and an axially inwardly facing surface engaging an axially outwardly facing surface on the arch member.

21. The improvement of claim 19, wherein the arch member is formed to include at least one sleeve-receiving slot having an opening facing away from the front opening in the knob shell and the knob sleeve includes a prong extending in a directin toward the front opening in the knob shell to engage in the at least one sleeve-receiving slot to interconnect the knob sleeve and the arch member.

22. In a door handle assembly of the type having a knob sleeve supported for rotation about an axis to actuate a latch bolt, a knob shell formed to include an interior cavity having a front opening, and a lock core disposed in the interior cavity to control locking and unlocking of the latch bolt, the lock core being of Figure 8 cross-section and including an upper lobe and an integral lower lobe, the improvement comprising a unitary core retainer sleeve coupled to the knob shell for rotation therewith and extending into the interior cavity, the unitary core retainer sleeve including a core support fixture positioned to lie in close proximity to the front opening of the interior cavity, the core support fixture including a base member underlying the lower lobe to support the lock core in the interior cavity and an arch member engaging the upper lobe to hold the lock core in said fixed position so that the lock core and the core retainer sleeve are interconnected to rotate as a unit in response to rotation of the knob shell about the axis of rotation of the knob sleeve, the lock core being seated on the core support fixture and inclucing means for releasably engaging the core support fixture to anchor the lock core in a fixed position on the core support fixture so that a user can insert a key into a keyway provided in the lock core through the front opening formed in the knob shell.

23. The improvement of claim 22, wherein the lock core includes a forward portion extending toward the front opening and a rearward portion extending away from the front opening, the engaging means includes a control lug situated on the rearward portion to lie intermediate the upper and lower lobes and means for moving the control lug relative to the lower lobe between a core-retaining position projected outwardly from the lower lobe and a core-releasing position retracted within the lower lobe, and the arch member engages the forward portion for the lock core and includes a rearwardly presented surface positioned to engage the control lug only upon movement of the control lug to its core-retaining position to block removal of the lock core from the interior cavity through the front opening formed in the knob shell.

24. The improvement of claim 22, wherein the arch member includes a front surface facing toward the front opening formed in the knob shell and the engaging means includes a rearwardly facing edge engaging the front surface of the arch member to establish said fixed position of the lock core on the core support fixture.

* * * * *